US009505123B2

(12) United States Patent
Johnson et al.

(10) Patent No.: US 9,505,123 B2
(45) Date of Patent: Nov. 29, 2016

(54) TOOL HOLDER

(71) Applicant: WAGIC, INC., Los Gatos, CA (US)

(72) Inventors: Ronald L. Johnson, San Jose, CA (US); Robert J. Gallegos, Fremont, CA (US); Steven Simas Escobar, San Jose, CA (US); Anders Scot Hudson, Campbell, CA (US); Idriss Mansouri-Chafik Ruiz, San Jose, CA (US); Yugen Patrick Lockhart, Palo Alto, CA (US); Howard Allen Wilson, Santa Clara, CA (US); Eric M. Colton, Torrance, CA (US)

(73) Assignee: Wagic, Inc., San Jose, CA (US)

( * ) Notice: Subject to any disclaimer, the term of this patent is extended or adjusted under 35 U.S.C. 154(b) by 0 days.

(21) Appl. No.: 13/932,780

(22) Filed: Jul. 1, 2013

(65) Prior Publication Data

US 2013/0284627 A1 Oct. 31, 2013

Related U.S. Application Data

(62) Division of application No. 12/009,532, filed on Jan. 17, 2008, now Pat. No. 8,499,667.

(51) Int. Cl.

| | |
|---|---|
| ***B25H 3/02*** | (2006.01) |
| ***B25B 15/00*** | (2006.01) |
| ***B25G 1/00*** | (2006.01) |

(Continued)

(52) U.S. Cl.

CPC ..... *B25H 3/022* (2013.01); *B25B 15/008* (2013.01); *B25G 1/005* (2013.01); *B25G 1/007* (2013.01); *B25G 3/02* (2013.01); *B25H 3/003* (2013.01); *B25H 3/02* (2013.01); *Y10T 16/469* (2015.01)

(58) Field of Classification Search

CPC ..... B25B 23/0021; B25B 23/0035; B25B 13/481; B25B 23/0042; B25B 15/008; B25B 23/16; B25G 1/043; B25G 1/005; B25G 1/063; B25G 3/18

USPC ..... 81/73, 177.2, 28, 30, 124.7, 177.5, 81/177.85, 180.1, 177.1

See application file for complete search history.

(56) References Cited

U.S. PATENT DOCUMENTS

| | | | |
|---|---|---|---|
| 244,309 | A | 7/1881 | Rhodes |
| 363,331 | A | 5/1887 | Hammer |
| 364,422 | A | 6/1887 | Laforge |

(Continued)

FOREIGN PATENT DOCUMENTS

| | | |
|---|---|---|
| CA | 1147176 | 5/1983 |
| CA | 1232781 A | 2/1988 |

(Continued)

*Primary Examiner* — Robert Scruggs
(74) *Attorney, Agent, or Firm* — Haverstock & Owens LLP

(57) ABSTRACT

A tool handle includes a cavity to receive a T-handle tool. When the tool handle is placed on the T-handle tool, the tool handle provides a better grip of the tool handle to apply greater torque. The tool handle includes a protrusion which is able to detachably couple with the T-handle tool. Once coupled with the T-handle tool, the tool handle is able to be grasped by a user to rapidly turn the T-handle tool. In some embodiments, the T-handle tool includes an added tool. A tool container is able to store T-handle tools and the tool handle. The tool container includes a locking mechanism to lock the tools in place and a tamper prevention mechanism to ensure the locking mechanism is not tampered with while the tool container is in the store.

15 Claims, 12 Drawing Sheets

(51) Int. Cl.

| | |
|---|---|
| ***B25H 3/00*** | (2006.01) |
| ***B25G 3/02*** | (2006.01) |

(56) References Cited

U.S. PATENT DOCUMENTS

| | | | |
|---|---|---|---|
| 580,235 | A | 4/1897 | Strum |
| 647,528 | A | 4/1900 | Schmidt |
| 763,745 | A | 6/1904 | Gheen |
| 776,761 | A | 12/1904 | Sampson |
| 873,363 | A | 12/1907 | Ross |
| 875,493 | A | 12/1907 | Beard |
| 959,408 | A | 5/1910 | Volbert |
| 1,000,900 | A | 8/1911 | Dorsey |
| 1,006,679 | A | 10/1911 | Rice |
| 1,100,070 | A | 6/1914 | Graham |
| 1,172,656 | A | 2/1916 | Yorgensen |
| 1,187,842 | A | 6/1916 | Kaas |
| D53,597 | S | 7/1919 | Marcmann |
| 1,398,583 | A | 11/1921 | Bovee |
| 1,425,270 | A | 8/1922 | Morgan |
| 1,500,852 | A | 7/1924 | Shepard |
| 1,502,044 | A | 7/1924 | McCann |
| 1,530,905 | A | 3/1925 | Nance |
| 1,559,097 | A | 10/1925 | Hill |
| 1,699,020 | A | 1/1929 | Raleigh |
| 1,753,026 | A | 4/1930 | Rosati |
| 1,825,936 | A | 6/1931 | Bodmer |
| 1,888,222 | A | 11/1932 | Curtis et al. |
| 1,915,245 | A | 6/1933 | Cook |
| 1,940,606 | A | 1/1934 | Little |
| 1,970,409 | A | 8/1934 | Wiedermann |
| 2,236,333 | A | 3/1941 | Cowies |
| 2,332,656 | A | 10/1943 | Mirando |
| 2,346,364 | A | 4/1944 | Dowe |
| D142,982 | S | 11/1945 | Bloomfield |
| 2,409,613 | A | 10/1946 | Brooks |
| 2,410,971 | A | 11/1946 | Hartley |
| 2,465,152 | A | 3/1949 | Ellison |
| 2,465,619 | A | 3/1949 | Veit |
| 2,475,268 | A | 7/1949 | Wittle |
| 2,485,991 | A | 10/1949 | Stowell |
| D156,677 | S | 12/1949 | Smith |
| D157,154 | S | 2/1950 | Horton |
| 2,509,507 | A | 5/1950 | Kane |
| 2,512,967 | A | 6/1950 | Quiron |
| 2,530,024 | A | 11/1950 | Moody |
| 2,532,636 | A | 12/1950 | Minnich |
| 2,569,069 | A | 9/1951 | Motel |
| 2,590,307 | A | 3/1952 | Gibson |
| 2,593,828 | A | 4/1952 | Arey |
| 2,604,211 | A | 7/1952 | Steine |
| 2,701,052 | A | 2/1955 | Martel |
| D175,056 | S | 6/1955 | Wilson |
| 2,715,028 | A | 8/1955 | Dossie |
| 2,719,042 | A | 9/1955 | Epsy |
| 2,726,091 | A | 12/1955 | Topar |
| 2,776,589 | A | 1/1957 | Gregory |
| 2,778,396 | A | 1/1957 | Swain |
| D179,979 | S | 4/1957 | Noga |
| 2,797,599 | A | 7/1957 | McGarvie |
| 2,800,816 | A | 7/1957 | Tasciotti |
| 2,804,970 | A | 9/1957 | Kuc et al. |
| 2,810,472 | A | 10/1957 | Midkiff |
| 2,836,210 | A | 5/1958 | Garofalo |
| 2,842,020 | A | 7/1958 | Traquino |
| 2,844,244 | A | 7/1958 | Hanson |
| 2,851,915 | A | 9/1958 | Martinez |
| 2,854,741 | A | 10/1958 | Cholger |
| 2,878,701 | A | 3/1959 | Weersma |
| 3,023,054 | A | 2/1962 | Shigekuni |
| 3,061,927 | A | 11/1962 | Von Frakenberg Und Ludwingdorf |
| 3,113,479 | A | 12/1963 | Swingle |
| 3,156,143 | A | 11/1964 | Wolf |
| 3,222,959 | A | 12/1965 | Clark |
| 3,255,792 | A | 6/1966 | Beck |
| 3,257,991 | A | 6/1966 | Mosch |
| D205,745 | S | 9/1966 | Namfeldt |
| 3,342,229 | A | 9/1967 | Janes |
| 3,343,434 | A | 9/1967 | Schroeder |
| 3,370,696 | A | 2/1968 | Dembicks |
| 3,424,039 | A | 1/1969 | Scott |
| 3,592,086 | A | 7/1971 | Derwin |
| 3,654,975 | A | 4/1972 | Ballsmith et al. |
| 3,667,518 | A | 6/1972 | Stillwagon, Jr. |
| 3,707,893 | A | 1/1973 | Hofman |
| 3,733,936 | A | 5/1973 | Flynn |
| 3,802,286 | A | 4/1974 | Winklofer et al. |
| 3,863,693 | A | 2/1975 | Carniker |
| 3,943,801 | A | 3/1976 | Yates |
| 3,958,469 | A | 5/1976 | Meese |
| 3,997,053 | A | 12/1976 | Bondhus |
| 4,000,767 | A | 1/1977 | Geng |
| 4,043,230 | A | 8/1977 | Scrivens |
| 4,124,915 | A | 11/1978 | Schlicher |
| 4,154,125 | A | 5/1979 | Frank |
| 4,196,761 | A | 4/1980 | Royer |
| 4,227,430 | A | 10/1980 | Jansson et al. |
| 4,235,269 | A | 11/1980 | Kraus |
| 4,238,862 | A | 12/1980 | Leatherman |
| 4,241,773 | A | 12/1980 | Personnat |
| 4,302,990 | A | 12/1981 | Chirchton et al. |
| 4,308,770 | A | 1/1982 | Macdonald |
| 4,310,094 | A * | 1/1982 | Hotchkiss, Jr. ..... B25H 3/04 211/70.6 |
| 4,327,790 | A | 5/1982 | Stevens et al. |
| 4,384,499 | A | 5/1983 | Shockley |
| D270,024 | S | 8/1983 | Strasser |
| 4,424,728 | A | 1/1984 | Macdonald |
| 4,448,097 | A | 5/1984 | Rocca |
| 4,469,109 | A | 9/1984 | Mehl |
| 4,476,751 | A | 10/1984 | Mishma |
| 4,525,889 | A | 7/1985 | Dunau |
| 4,542,667 | A | 9/1985 | Jang |
| D284,810 | S | 7/1986 | Kelemen, Sr. |
| 4,598,822 | A | 7/1986 | Hemmings |
| 4,621,718 | A | 11/1986 | Decarolis |
| 4,640,155 | A | 2/1987 | Condon |
| 4,667,822 | A * | 5/1987 | Coopmans ..... B25H 3/04 206/223 |
| 4,699,020 | A * | 10/1987 | Bush ..... B25B 27/0028 74/544 |
| 4,699,030 | A | 10/1987 | Yang |
| 4,703,673 | A | 11/1987 | Allen |
| 4,711,353 | A | 12/1987 | Rozmestor |
| 4,715,346 | A | 12/1987 | Dempsey |
| 4,716,795 | A | 1/1988 | Corona et al. |
| 4,716,796 | A | 1/1988 | Corona et al. |
| 4,767,006 | A | 8/1988 | Wasem |
| 4,783,867 | A | 11/1988 | Tsao |
| 4,787,276 | A | 11/1988 | Condon |
| 4,815,346 | A | 3/1989 | Littlehorn |
| 4,819,523 | A | 4/1989 | Souza |
| 4,819,800 | A | 4/1989 | Wilson |
| 4,820,090 | A | 4/1989 | Chen |
| 4,882,841 | A | 11/1989 | Margolis |
| 4,922,569 | A | 5/1990 | Brinker |
| 4,926,721 | A | 5/1990 | Hsiao |
| D308,462 | S | 6/1990 | Komatsu |
| 4,934,223 | A | 6/1990 | Wong |
| D310,140 | S | 8/1990 | Borque |
| D310,770 | S | 9/1990 | Zmarripa |
| D311,124 | S | 10/1990 | Learney |
| 4,960,016 | A | 10/1990 | Seals |
| 4,974,477 | A | 12/1990 | Anderson |
| 4,979,407 | A | 12/1990 | Hernandez et al. |
| 5,029,707 | A | 7/1991 | Feng |
| 5,036,975 | A | 8/1991 | Chow |
| 5,042,658 | A | 8/1991 | Tiramani et al. |
| 5,062,173 | A | 11/1991 | Collins et al. |
| 5,063,796 | A | 11/1991 | Gennep |
| 5,065,487 | A | 11/1991 | Yother |
| 5,086,674 | A | 2/1992 | Her |
| 5,146,815 | A | 9/1992 | Scott, III |

(56) References Cited

U.S. PATENT DOCUMENTS 5,147,038 A 9/1992 Pergeau
D333,769 S * 3/1993 Jureckson ..... D6/682.2
D334,516 S 4/1993 Tsunoda
D339,048 S 9/1993 Baum
5,251,352 A 10/1993 Cullison
5,263,389 A 11/1993 Frazell et al.
5,265,504 A 11/1993 Fruhm
D342,433 S 12/1993 Sorenson
5,271,300 A 12/1993 Zurbuchen et al.
D343,106 S 1/1994 Eklind et al.
5,295,422 A 3/1994 Chow
5,320,004 A 6/1994 Hsiao
5,394,984 A 3/1995 Aiba
D359,671 S 6/1995 Acosta
5,421,225 A 6/1995 Chen
5,450,774 A 9/1995 Chang
5,461,950 A 10/1995 Iwinski
D365,681 S 1/1996 Chow
5,480,166 A 1/1996 Milsop
5,495,942 A 3/1996 Ishak
5,499,560 A 3/1996 Aeschliman
5,499,562 A 3/1996 Feng
5,505,316 A * 4/1996 Lee ..... B25H 3/04 206/376
5,517,885 A 5/1996 Feng
5,522,291 A 6/1996 Liu
5,535,882 A 7/1996 Liu
5,542,322 A 8/1996 Knox et al.
D373,943 S 9/1996 Fuhrmann
5,553,340 A 9/1996 Brown, Jr.
5,566,596 A 10/1996 Lin
D376,520 S 12/1996 Morin
5,581,834 A 12/1996 Collins
D377,444 S 1/1997 Lin
5,592,859 A 1/1997 Johnson et al.
D378,797 S 4/1997 Poremba et al.
5,630,342 A 5/1997 Owoc
D380,131 S 6/1997 Sung
D382,190 S 8/1997 Blackston et al.
5,653,525 A 8/1997 Park
D383,048 S 9/1997 Sorenson et al.
5,662,013 A 9/1997 Lin
D385,172 S 10/1997 Bramsiepe et al.
D386,955 S 12/1997 Jones et al.
5,692,656 A 12/1997 Dembicks
D388,609 S 1/1998 Chan
5,711,042 A 1/1998 Chuang
5,711,194 A 1/1998 Anderson et al.
D394,792 S 6/1998 Bourque
D394,794 S 6/1998 Vasudeva
5,758,870 A 6/1998 Weaver
5,765,247 A 6/1998 Seber et al.
5,765,454 A 6/1998 Barbulescu et al.
5,768,960 A 6/1998 Archuleta
5,791,211 A 8/1998 Bondhus et al.
5,802,936 A 9/1998 Liu
5,803,584 A 9/1998 Chung
5,816,401 A 10/1998 Vasudeva et al.
5,820,288 A 10/1998 Cole
5,822,830 A 10/1998 Lin
D400,775 S 11/1998 Hsu
5,855,274 A 1/1999 Piao
D405,335 S 2/1999 Lin
D408,253 S 4/1999 Rowlay
5,911,799 A 6/1999 Johnson et al.
5,916,277 A 6/1999 Dallas
5,916,341 A 6/1999 Lin
5,918,513 A 7/1999 Ho
5,918,741 A 7/1999 Vasudeva
5,938,028 A 8/1999 Hu
5,970,828 A 10/1999 Bondhus et al.
D415,946 S 11/1999 Tsai
5,983,759 A 11/1999 Turner
5,992,626 A 11/1999 Anderson
D418,731 S 1/2000 Rowlay et al.
D420,885 S 2/2000 Lin
6,032,332 A 3/2000 Lin
6,032,796 A * 3/2000 Hopper et al. ..... 206/377
1,337,769 A 4/2000 Hemming
6,044,973 A 4/2000 Vasudeva
D426,449 S 6/2000 Eklind
D426,450 S 6/2000 Eklind
D427,875 S 7/2000 Chiu
6,085,620 A 7/2000 Anderson et al.
6,088,861 A 7/2000 Sessions et al.
6,089,133 A * 7/2000 Liao ..... 81/438
6,092,656 A 7/2000 Ernst
6,095,018 A 8/2000 Schuster
6,105,767 A 8/2000 Vasudeva
6,128,981 A 10/2000 Bondhus et al.
6,131,740 A 10/2000 Huang
D433,613 S 11/2000 Jailin
D433,910 S 11/2000 Oliver et al.
6,151,998 A 11/2000 Fu-Hui
D435,415 S 12/2000 Johnson et al.
6,164,172 A 12/2000 Huang
D435,773 S 1/2001 Lin
D437,541 S 2/2001 Hermansen et al.
D437,763 S 2/2001 Oliver et al.
6,186,785 B1 2/2001 Rogers et al.
6,202,864 B1 3/2001 Ernst et al.
6,206,189 B1 3/2001 Huot, Jr. et al.
D440,852 S 4/2001 Ernst
6,233,769 B1 5/2001 Seber et al.
6,237,451 B1 5/2001 Wei
6,257,106 B1 7/2001 Anderson et al.
6,260,453 B1 7/2001 Anderson et al.
6,279,434 B1 8/2001 Brown
6,279,435 B1 8/2001 Zayat, Jr.
6,295,903 B1 10/2001 Tripper et al.
6,305,248 B1 10/2001 Rowlay
6,308,599 B1 10/2001 Fu-Hui
6,311,587 B1 11/2001 Johnson et al.
6,314,600 B1 11/2001 Cachot
6,314,838 B2 11/2001 Wall
6,318,218 B1 11/2001 Anderson et al.
6,332,381 B1 12/2001 Vasudeva
6,345,557 B1 2/2002 Kuo
D454,766 S 3/2002 Lin
6,352,010 B1 3/2002 Giarritta et al.
6,357,068 B1 3/2002 Seber et al.
D455,630 S 4/2002 Chiu
6,371,290 B1 4/2002 Yearous et al.
6,378,402 B1 4/2002 Kalomeris et al.
6,382,057 B1 5/2002 Kienholz
6,389,931 B1 5/2002 Delaney et al.
6,397,709 B1 6/2002 Wall
6,401,576 B1 6/2002 Wu
6,401,923 B1 6/2002 Huang
6,405,620 B2 6/2002 Liao
D459,967 S 7/2002 Johnson et al.
D461,311 S 8/2002 Gharib
6,427,564 B1 8/2002 Nelson
6,490,954 B2 12/2002 Johnson et al.
6,510,767 B1 1/2003 Rivera
D472,712 S 4/2003 Sagen
D472,931 S 4/2003 Leins
6,564,680 B1 5/2003 Rinner et al.
6,598,503 B1 7/2003 Cunningham
6,601,481 B2 8/2003 Chuang
6,606,925 B1 8/2003 Gmeilbauer
D479,963 S 9/2003 Chang
6,634,502 B1 10/2003 Yu
6,640,675 B1 11/2003 Chuang
6,675,678 B2 1/2004 Liu
6,698,318 B2 3/2004 Peters
6,701,813 B2 * 3/2004 Hu ..... 81/467
6,709,196 B1 3/2004 Medendorp
6,739,224 B1 5/2004 Wershe
6,751,819 B2 6/2004 Chuang
6,751,820 B1 6/2004 Wu
6,752,046 B1 6/2004 Lee
6,758,350 B2 * 7/2004 Lin ..... 211/70.6
6,763,744 B2 7/2004 Johnson et al.

(56) References Cited

U.S. PATENT DOCUMENTS

D494,438 S 8/2004 Falkenstein et al.
6,799,490 B1 10/2004 Chu
6,827,210 B2 12/2004 Chen
6,863,471 B2 3/2005 Medendorp
6,877,186 B2 4/2005 Shiao
6,898,998 B2 5/2005 Shyu
6,901,826 B2 6/2005 Huang
6,918,323 B2 7/2005 Arnold et al.
6,922,870 B2 8/2005 Tontz, Sr.
6,925,910 B2 8/2005 Alford
6,928,908 B1 8/2005 Yu
6,935,211 B2 8/2005 Chen
6,935,212 B2 8/2005 Wadsworth
6,941,843 B2 9/2005 Johnson et al.
6,948,406 B1 9/2005 Li
6,968,758 B2 11/2005 Lin
6,988,616 B2 1/2006 Chen
7,028,593 B1 4/2006 Lin et al.
7,047,847 B2 5/2006 Chuang
7,051,626 B1 5/2006 Chen et al.
7,051,629 B2 5/2006 Huang
D523,637 S 6/2006 Chang
7,066,061 B1 6/2006 Chen et al.
7,073,418 B2 7/2006 Kuo
7,080,582 B2 7/2006 Karle
7,086,314 B2 8/2006 Wannop
7,093,519 B1 8/2006 Huang
D527,903 S 9/2006 Chan
7,100,476 B1 9/2006 Feit
7,131,358 B2 11/2006 Hsien
7,140,280 B2 11/2006 Hawkins et al.
7,143,669 B2 12/2006 Hu
7,150,208 B2 12/2006 Debley
7,155,998 B1 1/2007 Shyu
7,159,260 B2 1/2007 Hansen
7,159,491 B1 1/2007 Chaconas et al.
7,165,479 B1 1/2007 Lee
7,168,345 B1 1/2007 Hsieh
7,182,003 B1 2/2007 Hsieh
7,185,565 B1 3/2007 Hu
7,216,569 B2 5/2007 Abdelgany
7,237,463 B1 7/2007 Lee
D548,464 S 8/2007 Lin
7,284,466 B1 10/2007 Ho
D557,099 S 12/2007 Lin
7,305,908 B2 12/2007 Chi
7,409,894 B1 8/2008 Valentine
7,467,574 B1 12/2008 Lin
7,467,575 B2 12/2008 Lai
7,565,852 B2 7/2009 Yu
7,571,517 B2 8/2009 Smith et al.
7,600,640 B2 10/2009 Hallee et al.
D604,509 S 11/2009 Andrews
7,698,972 B2 4/2010 Hi
7,743,685 B2 6/2010 Chang
D622,125 S 8/2010 Robinson
D623,037 S 9/2010 Johnson et al.
7,788,996 B2 9/2010 Johnson et al.
7,810,415 B2 10/2010 Adamany et al.
7,815,058 B2 * 10/2010 Cheng ..... B25H 3/04 206/349
7,836,534 B2 11/2010 Simmons
7,846,203 B2 12/2010 Cribier
7,946,203 B2 5/2011 Johnson et al.
8,011,277 B2 9/2011 Johnson et al.
8,015,642 B1 9/2011 Oakley
D650,257 S 12/2011 Royes et al.
8,336,428 B2 12/2012 Johnson et al.
8,468,916 B2 6/2013 Johnson et al.
8,613,121 B1 12/2013 White
8,640,574 B2 2/2014 Johnson et al.
2001/0005576 A1 6/2001 Rogers et al.
2001/0045145 A1 11/2001 Legg
2003/0000902 A1 * 1/2003 Keis et al. ..... 211/89.01
2003/0047474 A1 3/2003 Dahlson
2003/0126957 A1 7/2003 Huang
2003/0136234 A1 7/2003 Cunningham
2003/0188610 A1 * 10/2003 Lin ..... 81/440
2003/0226428 A1 12/2003 Liu
2004/0050218 A1 3/2004 Napoli
2004/0173061 A1 9/2004 Liou
2004/0262344 A1 12/2004 White
2005/0011318 A1 1/2005 Tsai
2005/0199108 A1 9/2005 Jheng
2005/0229752 A1 10/2005 Nickipuck
2005/0247587 A1 11/2005 Holland-Letz
2005/0268754 A1 12/2005 Fa
2005/0284267 A1 12/2005 Liao et al.
2006/0042428 A1 3/2006 Chuang
2006/0101955 A1 5/2006 Chang
2006/0118500 A1 6/2006 Chen
2006/0150784 A1 7/2006 Hsieh
2006/0254396 A1 11/2006 Hu
2006/0288531 A1 12/2006 Hu
2006/0288823 A1 12/2006 Schepman
2007/0023306 A1 * 2/2007 Lai ..... 206/372
2007/0044559 A1 3/2007 Andrews
2007/0044598 A1 3/2007 Frohm et al.
2007/0056117 A1 3/2007 Gardiner et al.
2007/0056872 A1 3/2007 Begim
2007/0062831 A1 3/2007 Chen
2007/0084740 A1 4/2007 Malek
2007/0141885 A1 * 6/2007 Chen ..... B25H 3/04 439/266
2007/0151402 A1 7/2007 Schneerman et al.
2007/0186731 A1 8/2007 Schnarr et al.
2007/0221017 A1 9/2007 Heaven
2007/0228672 A1 10/2007 Huang
2007/0245862 A1 10/2007 Gonzalez et al.
2007/0295171 A1 12/2007 Johnson et al.
2008/0128370 A1 6/2008 Shih
2008/0148909 A1 6/2008 Lai
2008/0156754 A1 7/2008 Cheng
2008/0164171 A1 7/2008 Meng
2008/0190249 A1 8/2008 Yu
2008/0202963 A1 8/2008 Liao
2008/0223179 A1 9/2008 Nash et al.
2008/0251402 A1 10/2008 Chiu
2008/0256816 A1 10/2008 Consentino
2008/0271573 A1 11/2008 Lown et al.
2008/0295657 A1 12/2008 Culthe
2009/0107303 A1 4/2009 Steinweg et al.
2009/0183608 A1 7/2009 Johnson et al.
2009/0183609 A1 7/2009 Johnson et al.
2009/0241740 A1 10/2009 Heagerty
2010/0258465 A1 10/2010 Gomas
2011/0000024 A1 1/2011 Johnson et al.
2011/0094910 A1 4/2011 Fleury et al.
2012/0012485 A1 1/2012 Wang
2013/0228484 A1 9/2013 Yang

FOREIGN PATENT DOCUMENTS

CN 2628630 Y 7/2004
DE 464002 8/1928
DE 2035793 B1 3/1972
DE 2453480 A 5/1976
DE 3744176 A1 8/1989
DE 102004011892 1/2005
DE 202004013404 U1 3/2005
DE 20 2007 003841 U1 9/2007
EP 856233 12/1960
EP 503559 A1 9/1992
EP 618046 A1 10/1994
EP 01693163 2/2006
EP 1693163 2/2006
EP 01777042 4/2007
FR 787512 9/1935
JP 55045442 U 3/1980
JP 57-13165 1/1982
JP 61136778 6/1986
JP 3-47775 5/1991

(56) References Cited

FOREIGN PATENT DOCUMENTS

| | | |
|---|---|---|
| JP | 03103162 | 10/1991 |
| JP | 429368 | 3/1992 |
| JP | 5-31882 | 4/1993 |
| JP | 0850512 | 6/1996 |
| TW | I236402 | 7/2005 |
| TW | M284496 | 1/2006 |
| TW | M284500 | 1/2006 |
| TW | M296765 | 9/2006 |
| TW | I270445 | 1/2007 |
| WO | 83/01406 | 4/1983 |
| WO | 9412322 A1 | 6/1994 |
| WO | 9623631 | 8/1996 |
| WO | 97/29887 | 8/1997 |

* cited by examiner

TOOL HOLDER

This Patent Application is a divisional of the co-pending U.S. patent application Ser. No. 12/009,532, filed Jan. 17, 2008 and entitled "TOOL HOLDER." The co-pending U.S. patent application Ser. No. 12/009,532, filed Jan. 17, 2008 and entitled "TOOL HOLDER" is hereby incorporated by reference.

FIELD OF THE INVENTION

The present invention relates to the field of hand held tools. More specifically, the present invention relates to the field of T-handle tools and related safety, comfort, and convenience of accessories and tools.

BACKGROUND OF THE INVENTION

T-handle tools have a T-shaped body, including a long leg member and a short handle member. T-handles usually have hexagonal-shaped tips for use with screws and other objects designed to accept a hexagonal tip. Once inserted, rotational pressure is applied to the hexagonal wrench in order to tighten or loosen the screw. The leg member and handle of the hexagonal wrench are designed to be in the shape of the letter "T" so that a user is able to grasp the handle with his hand more comfortably.

T-handle tools are manufactured and distributed in multiple English and metric sizes in order to facilitate their use with screw heads of multiple sizes. Such tools are usually sold in a set which includes tools of multiple sizes but are also distributed individually.

When using a T-handle tool, a user will insert a leg end of the T-handle tool into the head of a workpiece such as a screw, and will then exert rotational pressure using the handle on the handle end of the tool in order to tighten or loosen the screw. Due to the shape of the T-handle tool it is particularly difficult to quickly turn a T-handle tool because the user must constantly remove and replace his hand on the handle as it turns. Furthermore, the handle is usually not very easy to grip.

SUMMARY OF THE INVENTION

A tool handle includes a cavity to receive a T-handle tool. When the tool handle is placed on the T-handle tool, the tool handle provides a better grip of the tool handle to apply greater torque. The tool handle includes a protrusion which is able to detachably couple with the T-handle tool. Once coupled with the T-handle tool, the tool handle is able to be grasped by a user to rapidly turn the T-handle tool. In some embodiments, the T-handle tool includes an added tool. A tool container is able to store T-handle tools and the tool handle. The tool container includes a locking mechanism to lock the tools in place and a tamper prevention mechanism to ensure the locking mechanism is not tampered with while the tool container is in the store.

In one aspect of the present invention, a tool handle comprises a tool handle body and a protruding member extending from the tool handle body, the protruding member configured to be inserted into a T-handle tool. The tool handle body farther comprises a cavity for the tool handle to detachably couple with the T-handle tool. The T-handle tool contains a receiving aperture for receiving the protruding member. In some embodiments, the protruding member is rounded and the receiving aperture is rounded to enable rotating of the T-handle tool. The tool handle body is longer and wider than the T-handle tool to enable better gripping of the T-handle tool. The tool handle body is configured to be positioned lengthwise vertically for rotating the T-handle tool. The T-handle tool further comprises a leg member and an arm member.

In another aspect of the present invention, a tool system comprises a T-handle tool and a tool handle further comprising a tool handle body and a protruding member extending from the tool handle body, the protruding member configured to be inserted into the T-handle tool. The tool handle body further comprises a cavity for the tool handle to detachably couple with the T-handle tool. The T-handle tool contains a receiving aperture for receiving the protruding member. In some embodiments, the protruding member is rounded and the receiving aperture is rounded to enable rotating of the T-handle tool. The tool handle body is longer and wider than the T-handle tool to enable better gripping of the T-handle tool. The tool handle body is configured to be positioned lengthwise vertically for rotating the T-handle tool. The T-handle tool further comprises a leg member and an arm member.

In yet another aspect of the present invention, a T-handle tool comprises a T-handle tool body and a receiving aperture contained within the T-handle tool body, the receiving aperture for receiving a protruding member of a tool handle. The tool handle further comprises a tool handle body which contains a cavity for the tool handle to detachably couple with the T-handle tool. The protruding member is rounded and the receiving aperture is rounded to enable rotating of the T-handle tool. The tool handle body is longer and wider than the T-handle tool to enable better gripping of the T-handle tool. The tool handle body is configured to be positioned lengthwise vertically for rotating the T-handle tool. The 1-handle tool further comprises a leg member and an arm member. The T-handle tool further comprises a rotating collar for stabilizing the T-handle tool body when the T-handle tool body is rotating.

In still yet another aspect of the present invention, a T-handle tool container comprises a tool container body configured to hold a group of one or more T-handle tools of multiple sizes securely upon insertion and a locking mechanism configured to lock the group of one or more T-handle tools within the tool container body.

In another aspect of the present invention, a method of storing a group of one or more T-handle tools securely, comprises inserting the group of one or more T-handle tools into a tool container, locking the group of one or more T-handle tools into the tool container with a locking mechanism and securing the locking mechanism in a locked position with a tamper prevention mechanism.

In yet another aspect of the present invention, a tool set comprises a group of one or more T-handle tools, a tool handle configured for detachably coupling with each of T-handle tools in the group of one or more T-handle tools and a tool container for storing the tool handle and the group of one or more T-handle tools.

DETAILED DESCRIPTION OF THE PREFERRED EMBODIMENT

A tool handle aids a user in gripping a T-handle tool and includes a protrusion for inserting into the T-handle tool to then rotate the T-handle tool. A T-handle tool includes a handle component, a rotating collar and a leg which includes a tool such as a hexagonal wrench end. A modified T-handle tool includes an arm to include an added tool such as another hexagonal wrench. A tool container stores the T-handle tools. In some embodiments, the tool container includes a locking mechanism for locking the tools in place. In some embodiments, the tool container also includes a tamper prevention mechanism for preventing the locking mechanism from being tampered with.

Figure 1A:
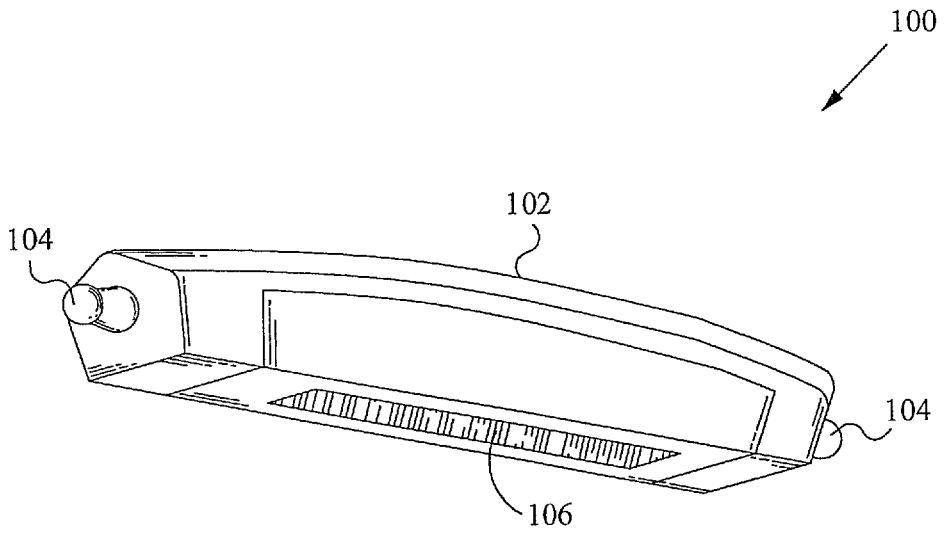
FIG. 1A illustrates a perspective view of a tool handle.

FIG. 1A illustrates a perspective view of a tool handle 100. The tool handle 100 includes a tool handle body 102, one or more protruding members 104 and a cavity 106. The tool handle body 102 comprises any material, including but not limited to, rubber, metal, wood and plastic. The tool handle body 102 is large enough to fit around a T-handle tool but not too large for a user to grasp comfortably. Specifically, in some embodiments, the tool handle body 102 is slightly longer and wider than the handle of the T-handle tool. In some embodiments, the tool handle body 102 is substantially rectangular. In some embodiments, the protruding members 104 extend from the tool handle body 102 at opposing ends. The protruding members 104 comprise any material, including but not limited to, rubber, metal, wood and plastic. In some embodiments, the protruding members 104 are rounded. The cavity 106 is shaped and sized to receive a T-handle tool 200 (FIG. 2A) so that the tool handle 100 is detachably coupled with the T-handle tool 200 (FIG. 2A).

Figure 1B:
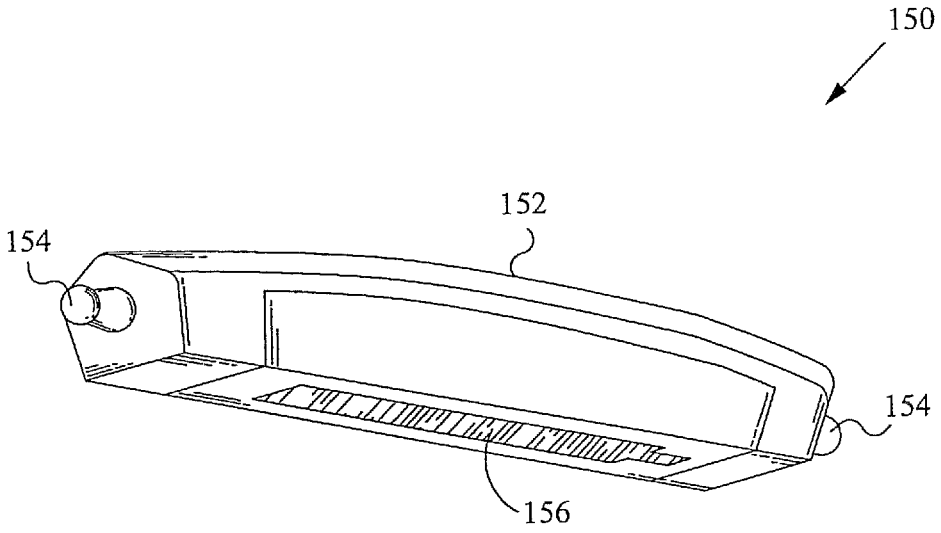
FIG. 1B illustrates a perspective view of a modified tool handle.

FIG. 1B illustrates a perspective view of a modified tool handle 150. The tool handle 150 includes a tool handle body 152, one or more protruding members 154 and a cavity 156. The tool handle body 152 comprises any material, including but not limited to, rubber, metal, wood and plastic. The tool handle body 152 is large enough to fit around a T-handle tool but not too large for a user to grasp comfortably. Specifically, in some embodiments, the tool handle body 152 is slightly longer and wider than the handle of the T-handle tool. In some embodiments, the tool handle body 152 is substantially rectangular. In some embodiments, the protruding members 154 extend from the tool handle body 152 at opposing ends. The protruding members 154 comprise any material, including but not limited to, rubber, metal, wood and plastic. In some embodiments, the protruding members 154 are rounded. The cavity 156 is shaped and sized to receive a modified T-handle tool 250 (FIG. 2B) so that the tool handle 150 is detachably coupled with the modified T-handle tool 250 (FIG. 2B).

Figure 2A:
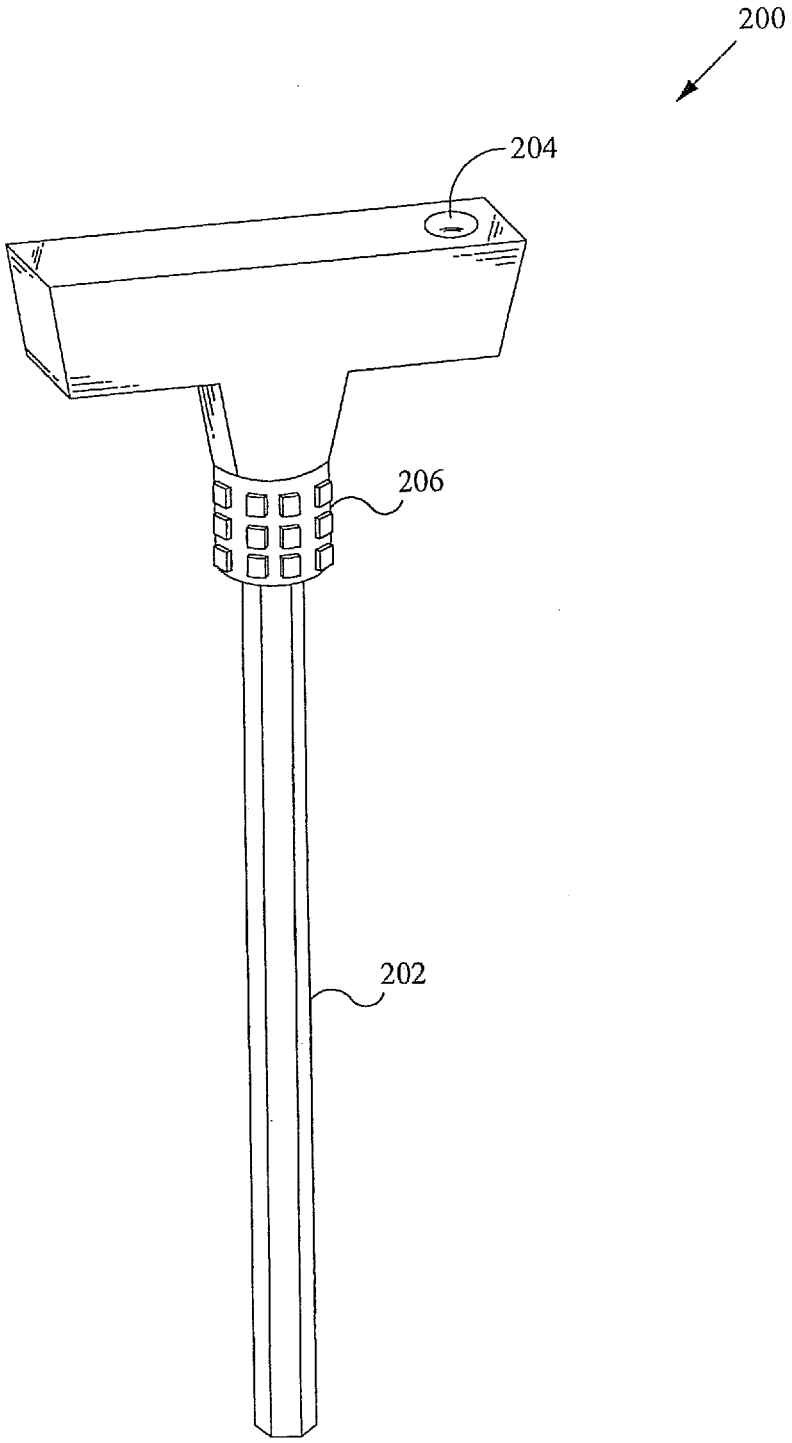
FIG. 2A illustrates a perspective view of a T-handle tool.

FIG. 2A illustrates a perspective view of a T-handle tool 200. The T-handle tool 200 includes a T-handle tool body 202 and a receiving aperture 204. The T-handle tool body 202 further includes a handle component and a leg component. A rotating collar 206 near the base of the handle component allows a user to stabilize the tool while turning the handle component. The rotating collar 206 is held in place by the user while the handle is turned. In some embodiments, the rotating collar 206 has ridges or small grooves. In some embodiments, the receiving aperture 204 is rounded. In some embodiments, the receiving aperture 204 is located on the top and near an end of the handle component of the T-handle tool body 202. In some embodiments, there are two or more receiving apertures 204, one at each end of the handle component. In some embodiments, the leg component includes a hexagonally-shaped head. The receiving aperture 204 is configured to receive a protruding member 104 (FIG. 1) of the tool handle 100 (FIG. 1).

Figure 2B:
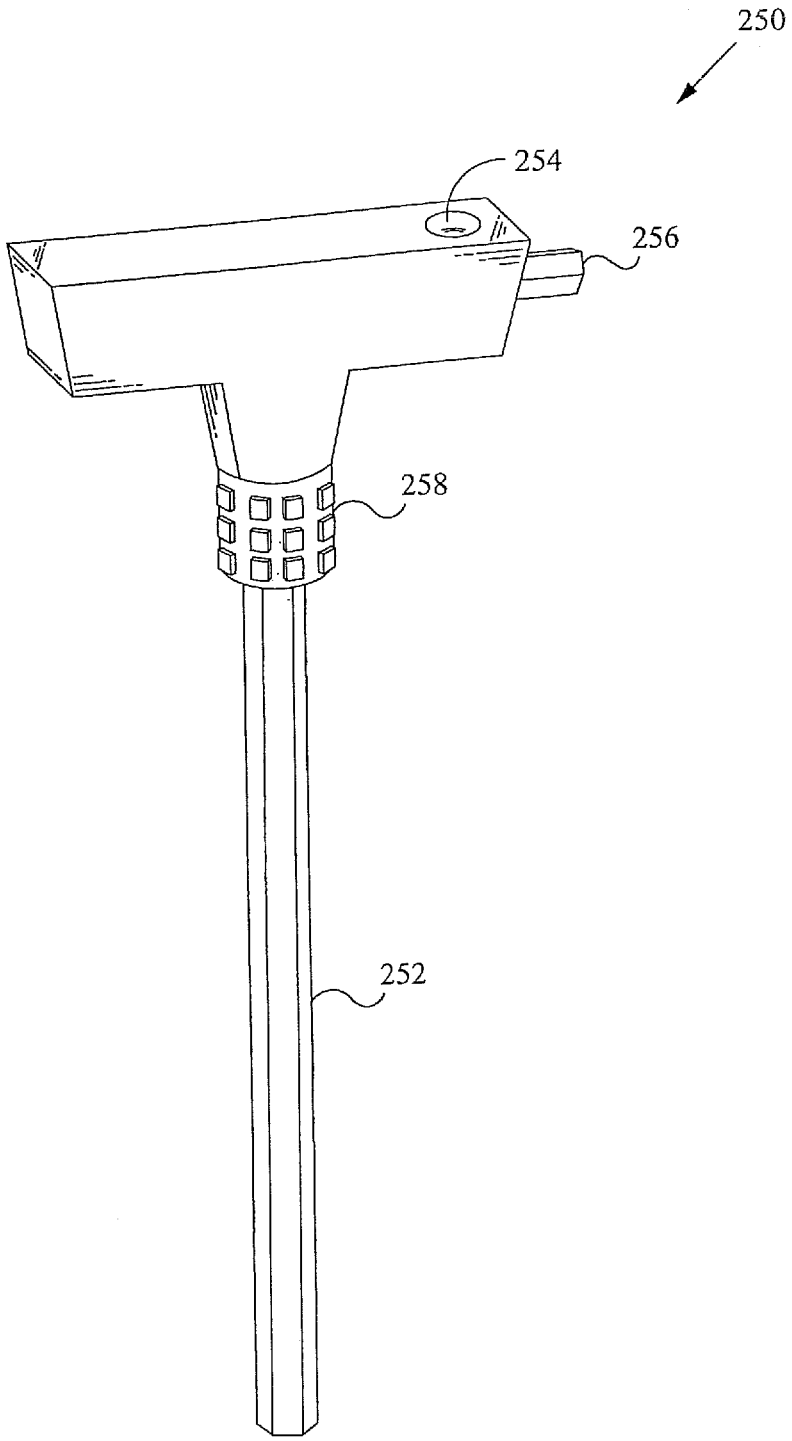
FIG. 2B illustrates a perspective view of a modified T-handle tool.

FIG. 2B illustrates a perspective view of a modified T-handle tool 250. The T-handle tool 250 includes a T-handle tool body 252, a receiving aperture 254 and an arm 256. The T-handle tool body 252 further includes a handle component and a leg component. A rotating collar 258 near the base of the handle component allows a user to stabilize the tool while turning the handle component. The rotating collar 258 is held in place by the user while the handle is turned. In some embodiments, the rotating collar 258 has ridges or small grooves. In some embodiments, the receiving aperture 254 is rounded. In some embodiments, the receiving aperture 254 is located on the top and near an end of the handle component of the T-handle tool body 252. In some embodiments, there are two receiving apertures 254 or more, one at each end of the handle component. In some embodiments, the leg component includes a hexagonally-shaped head. The receiving aperture 254 is configured to receive a protruding member 104 (FIG. 1) of the tool handle 100 (FIG. 1). In some embodiments, the arm 256 extends out from the handle component of the T-handle tool 200. In some embodiments, the arm 256 includes a hexagonally-shaped end.

Figure 3A:
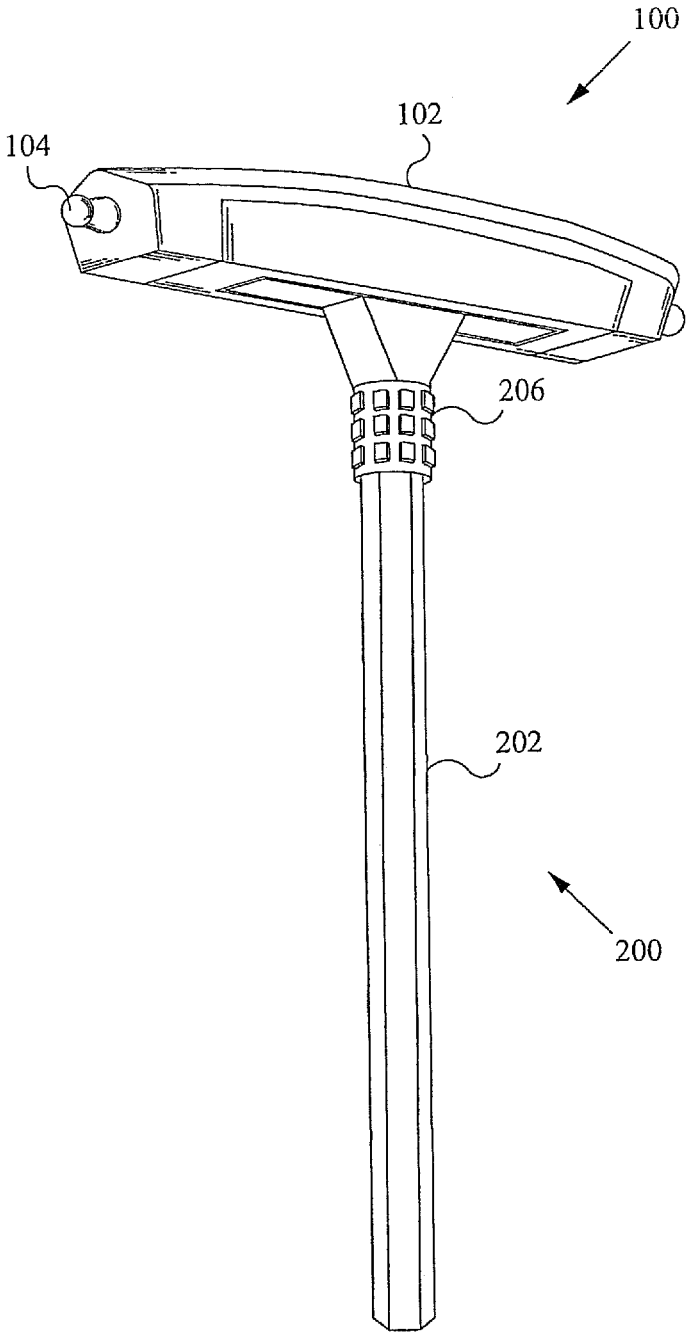
FIG. 3A illustrates a perspective view of a tool handle detachably coupled with a T-handle tool.

FIG. 3A illustrates a perspective view of a tool handle 100 detachably coupled with a T-handle tool 200. Specifically, the handle component of the T-handle tool body 202 is positioned within the cavity 106 (FIG. 1) of the tool handle body 102. When the T-handle tool body 202 is positioned within the cavity 106 (FIG. 1) of the tool handle body 102, a user has a larger handle to grip, thus making the T-handle tool 200 easier to grip and enabling the user to apply more torque with the T-handle tool 200. The user is also able to stabilize the T-handle tool 200 by holding a rotating collar 206.

Figure 3B:
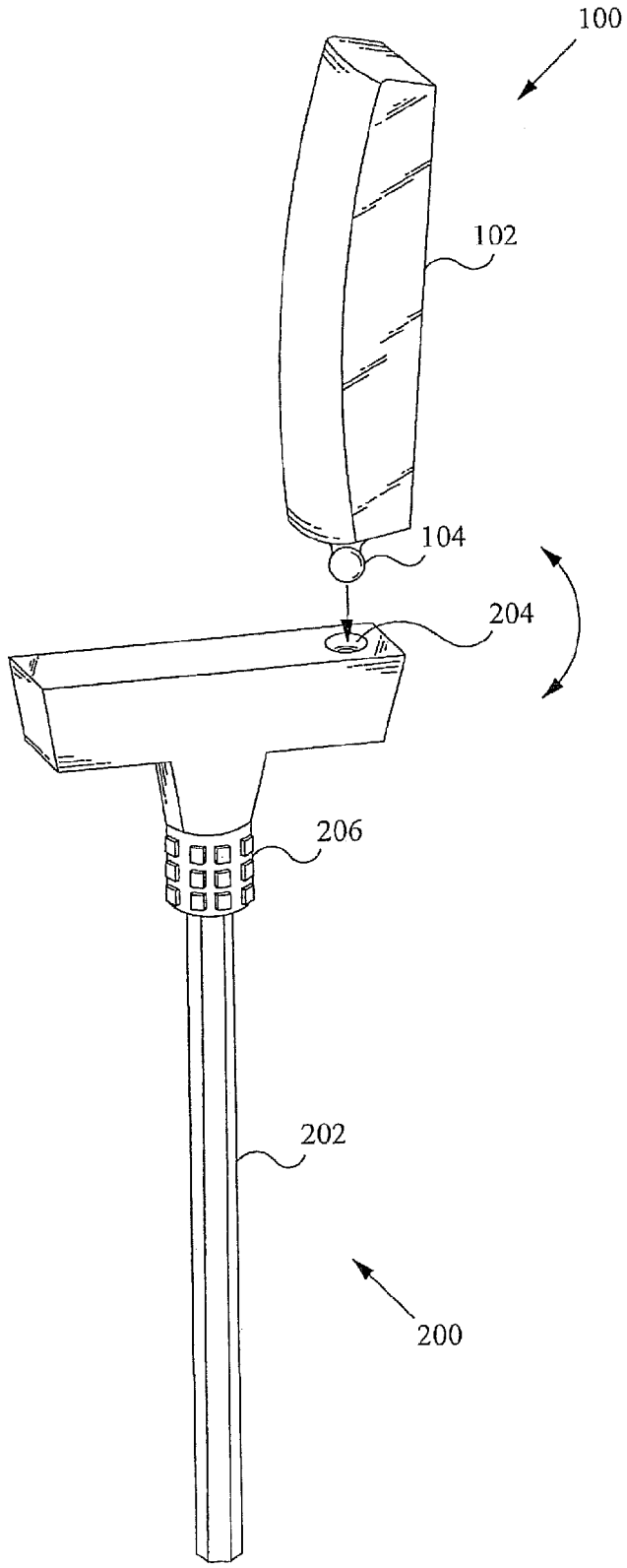
FIG. 3B illustrates a perspective view of a tool handle positioned to rotate the T-handle tool.

FIG. 3B illustrates a perspective view of a tool handle 100 positioned to rotate the T-handle tool 200. With the tool handle body 102 positioned lengthwise in the same direction as the plane of the T-handle tool body 202, the protruding member 104 is able to be positioned in the receiving aperture 204 of the T-handle tool 200. A user is then able to move the tool handle 100 in a circular motion which causes the T-handle tool 200 to rotate. By using the protruding member 104 and the aperture 204, the user does not have to keep removing his hand after every rotation of the T-handle tool 200. Furthermore, it is possible to move the tool handle 100 in a circular motion much faster than simply turning one's hands. Therefore, using the T-handle tool 200 with the tool handle 100 in this position, a user is able to much more rapidly rotate the T-handle tool 200 which is likely being used to install or remove a screw or another object. The user is also able to stabilize the T-handle tool 200 by holding a rotating collar 206.

Figure 4A:
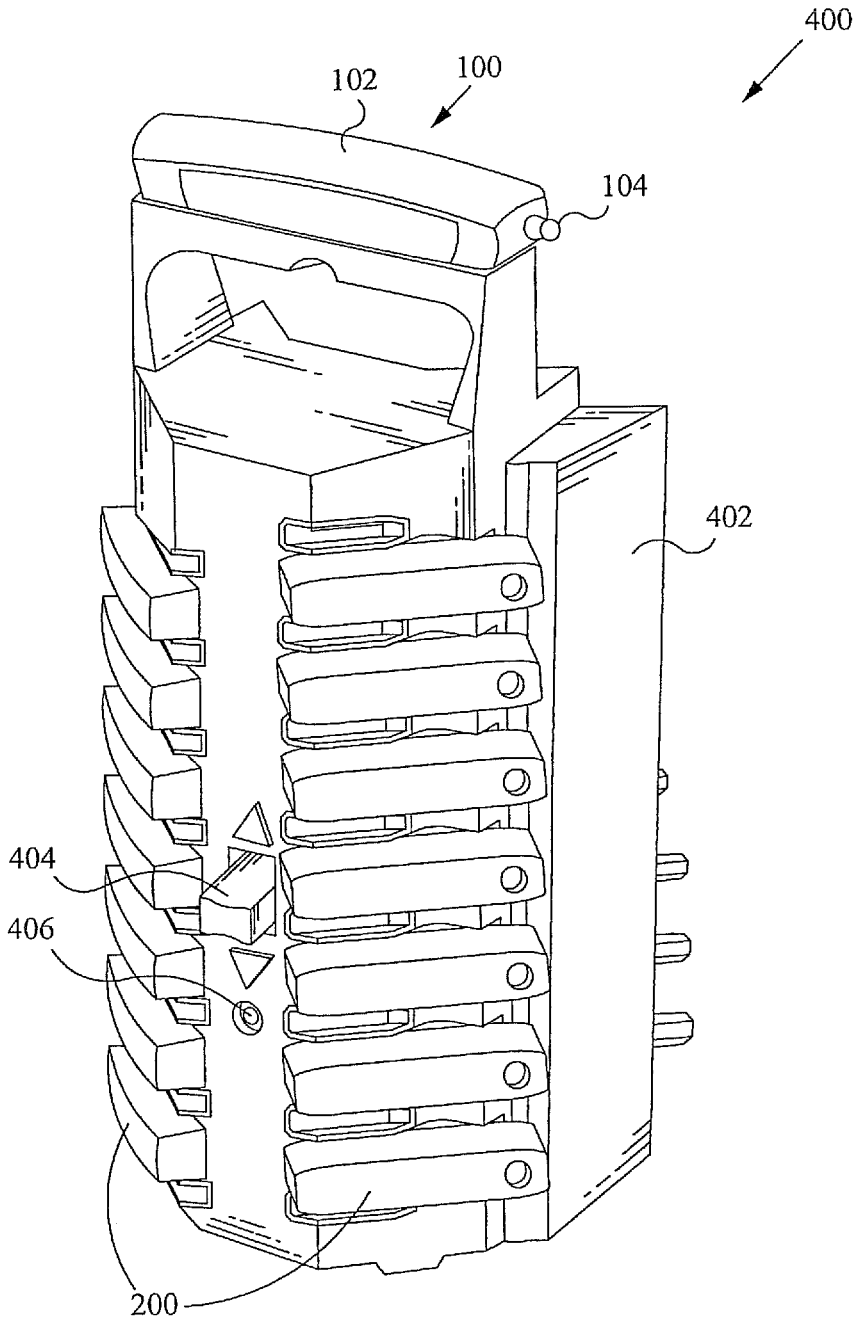
FIG. 4A illustrates a front side view of a tool container for storing a group of one or more T-handle tools.

FIG. 4A illustrates a front side view of a tool container 400 for storing a group of one or more T-handle tools 200. The tool container 400 includes a tool container body 402 with receiving slots/apertures 410 (FIG. 4C) for receiving each of the T-handle tools 200. In some embodiments, there are other means for receiving each of the T-handle tools 200. In some embodiments, the receiving slots 410 (FIG. 4C) are configured in columns with one column for storing Standard American Equivalent-sized tools and the second column for storing metric-sized tools. The tool container 400 also includes a receiving member 408 (FIG. 4C) for receiving a tool handle 100. A handle of the tool container 400 is configured to allow the tool container 400 to be hung in a store for display. A locking mechanism 404 is included within the tool container 400 to lock the tools 200 within the tool container 400. The locking mechanism 404 includes a tab which is able to be toggled between a lock and an unlock position. The locking mechanism 404 also includes a plate 412 (FIG. 4D) that is movable into locked and unlocked positions, where in the locked position, the plate 412 (FIG. 4D) applies pressure on the rotating collar of the T-handle tools, so that they are not removable. When the tools 200 are locked in place, they are unable to be removed or fall out from the tool container 400. A tamper prevention mechanism 406 is included within the tool container 400 to ensure the locking mechanism 404 is not tampered with. The tamper prevention mechanism 406 is any device which prevents the locking mechanism 404 from being moved such as a screw which secures the locking mechanism plate 412 (FIG. 4D) in place. For example, while a tool container is in a retail store to be sold, the locking mechanism is in the "lock" position, so that the tools are not able to be removed and stolen. To prevent someone from simply toggling the locking mechanism to the "unlock" position, the tamper prevention mechanism is used. With the tamper prevention mechanism in place, a would-be thief would have to bring a screwdriver, spend the time to remove the screw and then move the switch to the "unlock" position to steal a tool. Thus, the locking mechanism used in conjunction with the tamper prevention mechanism is sufficient to securely display the tool container and tools without having to worry about them being stolen. When the tools, the handle and the container are together they form a set.

Figure 4B:
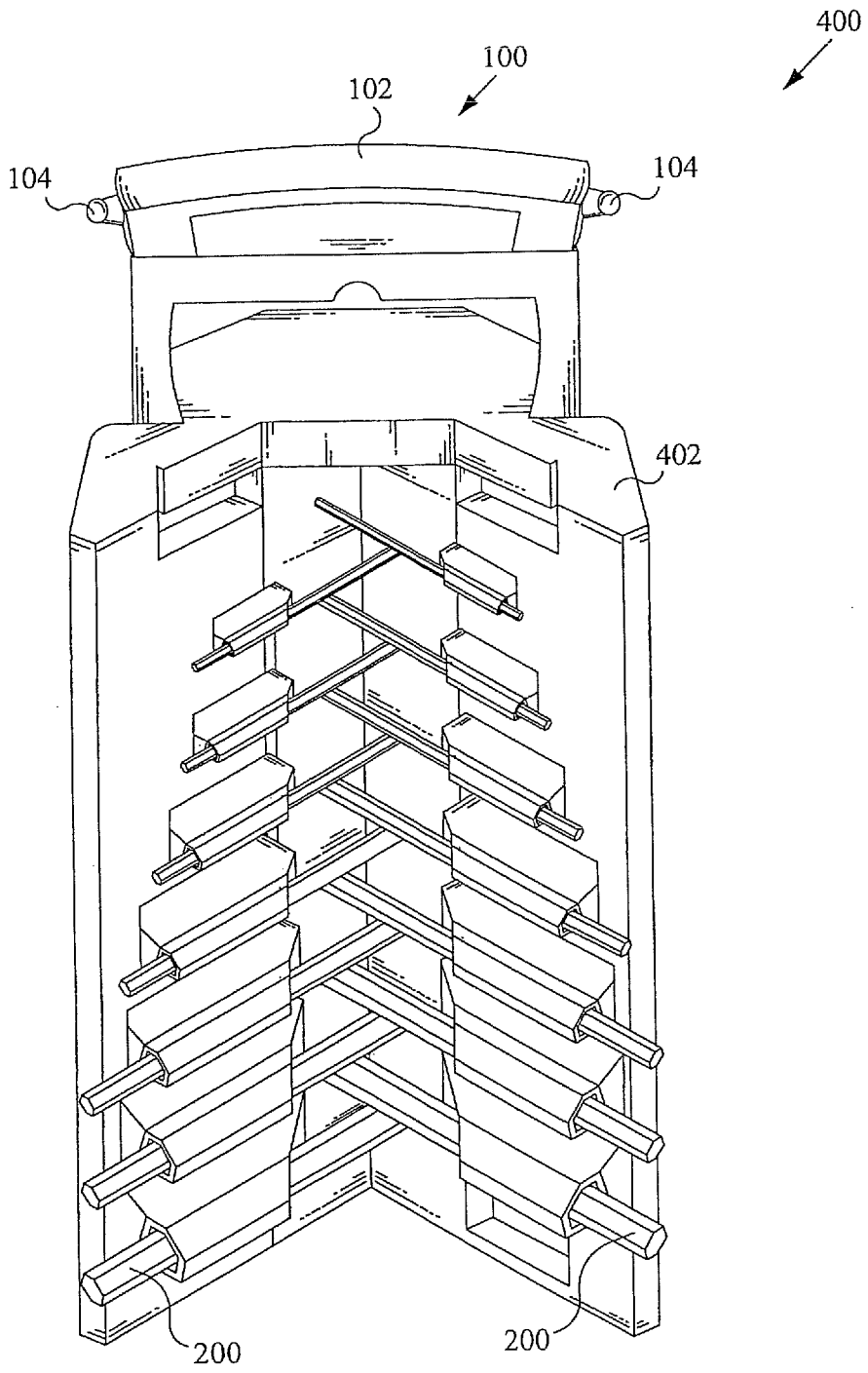
FIG. 4B illustrates a back view of a tool container for storing a group of one or more T-handle tools.

FIG. 4B illustrates a back view of a tool container 400 for storing a group of one or more T-handle tools 200. As described, in some embodiments, the tools 200 are stored in two columns. To minimize the size of the tool container 400, the tools 200 are stored in a criss-cross configuration, in some embodiments.

Figure 4C:
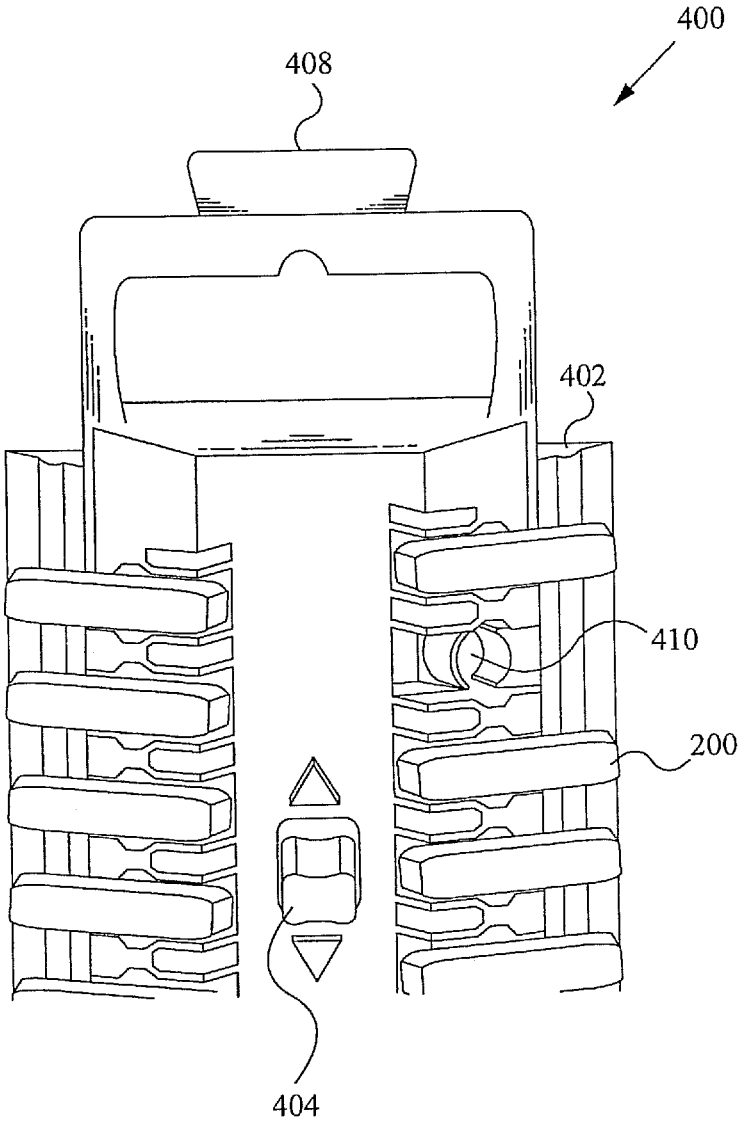
FIG. 4C illustrates a view of part of a tool container for storing a group of one or more T-handle tools.

FIG. 4C illustrates a view of part of a tool container 400 for storing a group of one or more T-handle tools 200. A receiving member 408 allows a tool handle 200 to be stored on the tool container 400. A receiving slot 410 is where a T-handle tool 200 is inserted to be stored in the tool container 400.

Figure 4D:
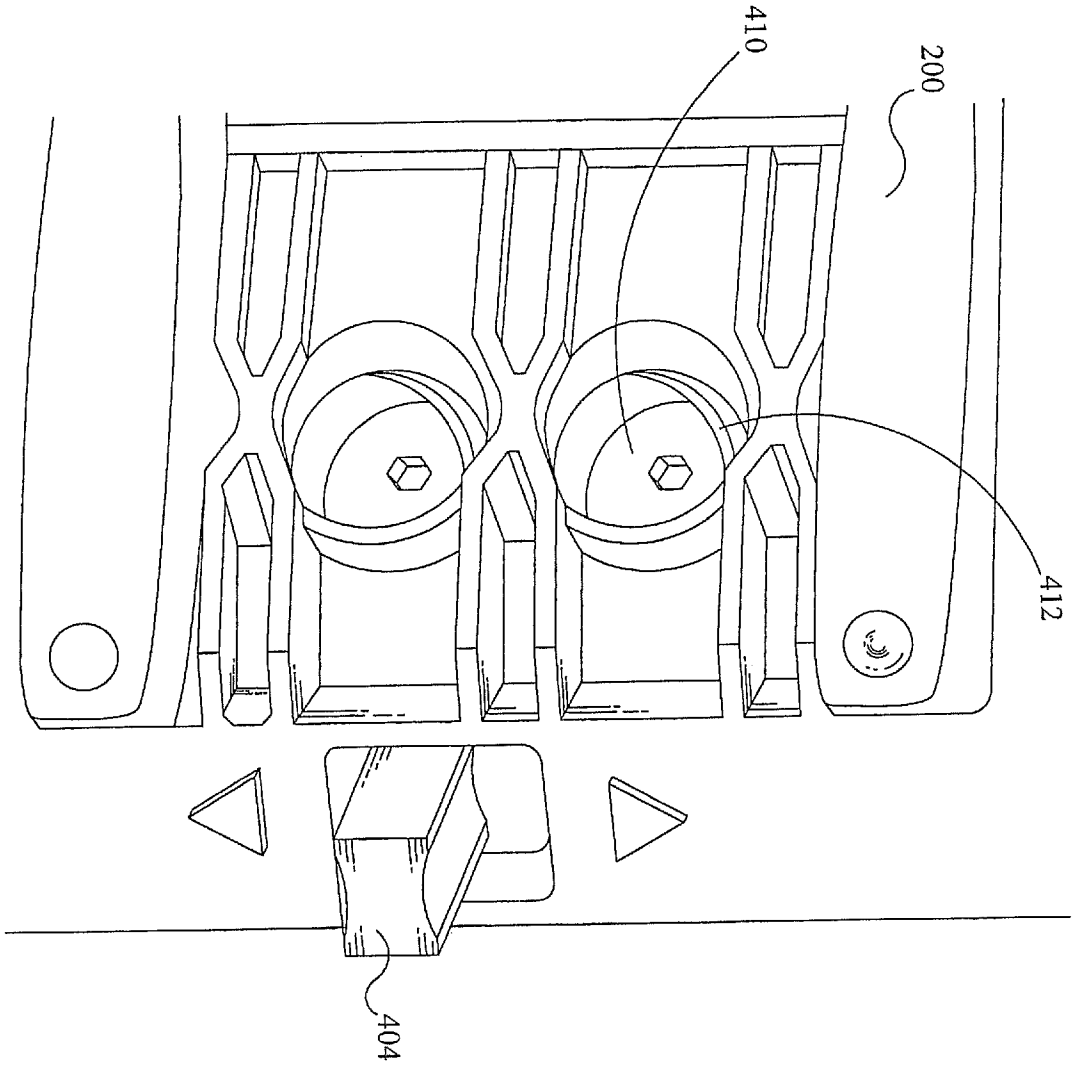
FIG. 4D illustrates a close-up view of part of a tool container for storing a group of one or more T-handle tools.

FIG. 4D illustrates a close-up view of part of a tool container 400 for storing a group of one or more T-handle tools 200. A locking mechanism plate 412 which is able to be part of a locking mechanism 404 locks the tools 200 in place by applying pressure against the rotating collar of the T-handle tool 200. The locking mechanism plate 412 is moved by moving a locking mechanism tab. The locking mechanism plate 412 moves against the rotating collar of each T-handle tool 200 and applies pressure against the rotating collar, when the locking mechanism 404 is in the "lock" position. When the locking mechanism 404 is in the "unlock" position, the locking mechanism plate 412 is moved away from the rotating collar of each T-handle tool 200 which relieves the pressure against the rotating collar, thus allowing the T-handle tool 200 to be removed. In some embodiments, the locking mechanism is implemented by other means.

Figure 4E:
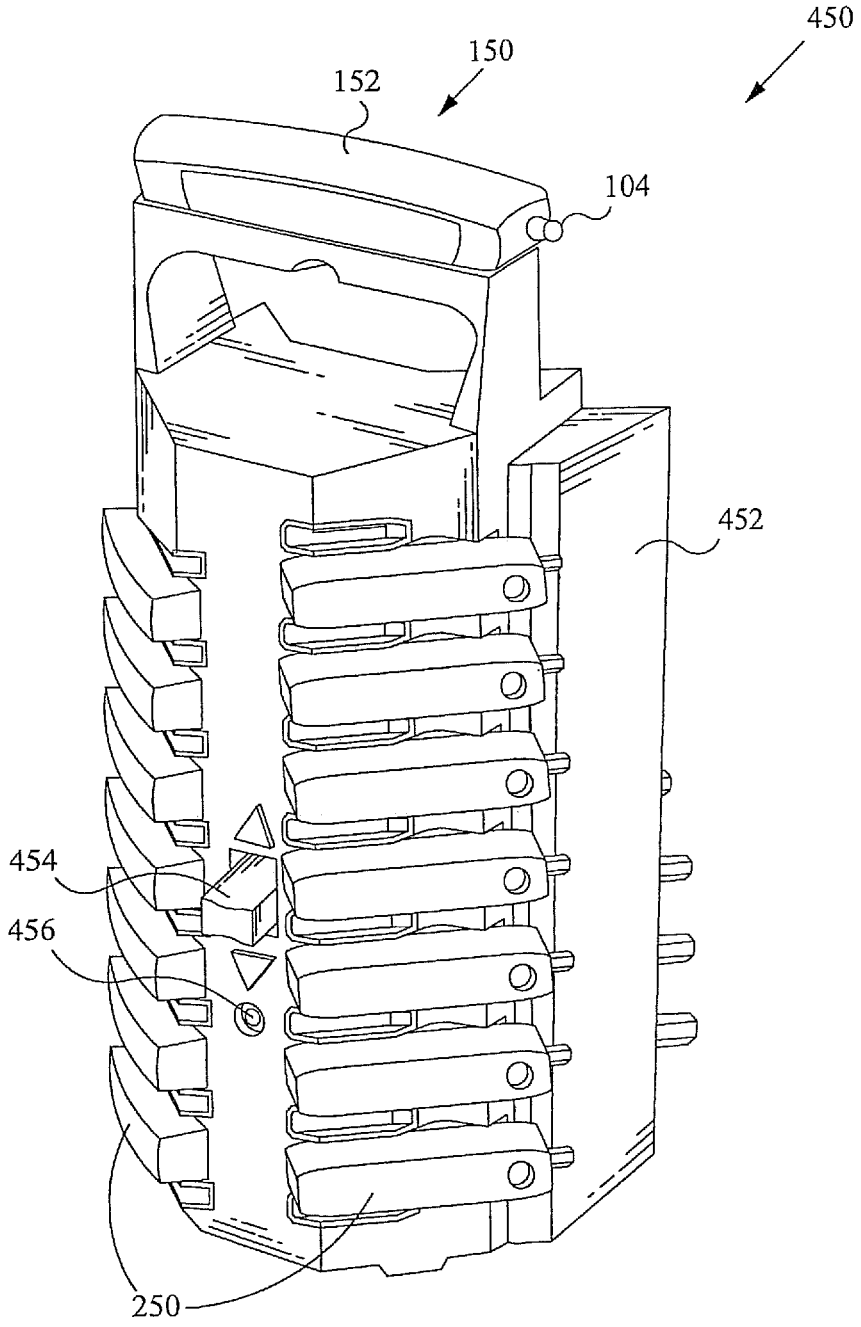
FIG. 4E illustrates a front side view of a tool container for storing a group of one or more T-handle tools.

FIG. 4E illustrates a front side view of a tool container 450 for storing a group of one or more T-handle tools 240. The tool container 450 includes a tool container body 452 with receiving slots/apertures 410 (FIG. 4C) for receiving each of the T-handle tools 250. In some embodiments, there are other means for receiving each of the T-handle tools 250. In some embodiments, the receiving slots 410 (FIG. 4C) are configured in columns with one column for storing Standard American Equivalent-sized tools and the second column for storing metric-sized tools. The tool container 450 also includes a receiving member 408 (FIG. 4C) for receiving a tool handle 150. In some embodiments, the receiving member is shaped more similarly to the aperture 156 (FIG. 1B). A handle of the tool container 450 is configured to allow the tool container 450 to be hung in a store for display. A locking mechanism 454 is included within the tool container 450 to lock the tools 250 within the tool container 450. The locking mechanism 454 includes a tab which is able to be toggled between a lock and an unlock position. The locking mechanism 454 also includes a plate that is movable into locked and unlocked positions, where in the locked position, the plate applies pressure on the rotating collar component of the T-handle tools, so that they are not removable. When the tools 250 are locked in place, they are unable to be removed or fall out from the tool container 450. A tamper prevention mechanism 456 is included within the tool container 450 to ensure the locking mechanism 454 is not tampered with. The tamper prevention mechanism 456 is any device which prevents the locking mechanism 454 from being moved such as a screw which secures the locking mechanism plate in place.

Figure 5:
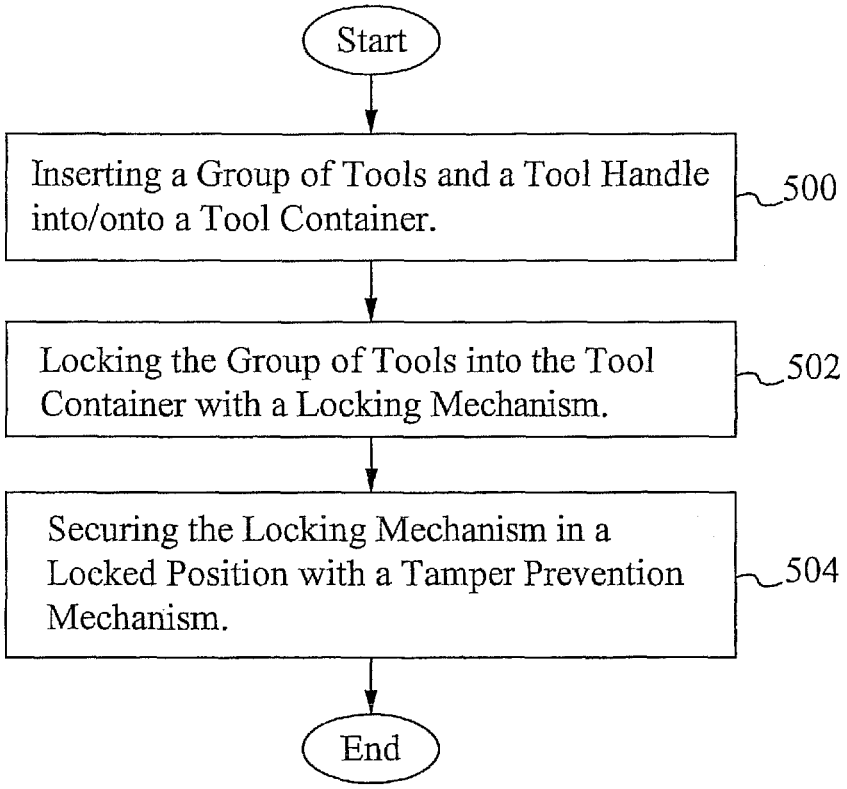
FIG. 5 illustrates a flowchart of a method of securing a group of one or more tools in a tool container.

FIG. 5 illustrates a flowchart of a method of securing a group of one or more tools in a tool container 400. In the step 500, the group of one or more tools 200 is inserted into the tool container 400. In some embodiments, a set of metric tools are inserted into a first column of the tool container 400 and a set of standard tools are inserted into a second column of the tool container 400. In some embodiments, a tool handle 100 is also inserted onto the tool container 400. In the step 502, the group of one or more tools 200 is locked within the tool container 400 with a locking mechanism 404. The locking mechanism 404 is locked by moving a locking tab into a "lock" position. In the step 504, the locking mechanism is secured in a locked position with a tamper prevention mechanism 406. With the tool container 400 secured in a locked position, the tools are not removable. A same or similar method is used to store the modified tools 250 and the modified tool handle 150 in the tool container 450.

The tool handle is utilized by detachably coupling the tool handle and the T-handle tool, and grasping the tool handle and T-handle tool combination with one hand. Specifically, the T-handle tool is placed within the cavity of the tool handle. The tool handle is also utilized to more quickly rotate the T-handle tool by positioning the tool handle appropriately, inserting a protruding member of the tool handle into a receiving aperture of the T-handle tool and then moving the tool handle in a circular motion. The T-handle tool is still utilized as standard T-handle tool to insert or remove an object that is capable of receiving the T-handle tool.

To utilize the tool container one or more tools are inserted into the tool container. A tool handle is also able to be stored with the tool container. The tools are easily accessible in the tool container. Furthermore, while available for purchase, such as in a retail store, a locking mechanism and a tamper prevention mechanism ensure that no tools are stolen from the tool container. After or while the tool container is purchased, a user or a store employee removes the tamper prevention mechanism. Then, the user is able to remove, utilize and return the tools to the tool container as desired. The user is still able to lock the tools within the tool container to ensure the tools do not fall out. In some embodiments, the user is able to retain and reuse the tamper prevention mechanism to lock and ensure, for example, children are unable to access the tools.

In operation, the tool holder provides a larger grip for the T-handle tool. The tool holder is also able to act as a handle to rotate the T-handle tool similar to a hand crank.

In operation, the tool container includes a locking mechanism and a tamper prevention mechanism which are able to be used to allow the tool container and tools to be displayed yet protected from theft without the need for additional packaging. This removes the need for expensive added containment materials such as plastic that goes all around the tool container. Moreover, since the retaining mechanism utilizes less plastic, it is also more environmentally friendly. The tool container after purchase is also able to securely store the tool for easy access and use.

The present invention has been described in terms of specific embodiments incorporating details to facilitate the understanding of principles of construction and operation of the invention. Such reference herein to specific embodiments and details thereof is not intended to limit the scope of the claims appended hereto. It will be readily apparent to one skilled in the art that other various modifications may be made in the embodiment chosen for illustration without departing from the spirit and scope of the invention as defined by the appended claims.

What is claimed is:

1. A T-handle tool container for holding a plurality of T-handle tools each having a long leg member and a short handle member and in the shape of a T and a tool handle comprising a cavity for receiving one of the plurality of the T-handle tools, the tool container comprising:

a. a tool container body configured to hold a group of one or more T-handle tools of multiple sizes securely upon insertion into the tool container, the tool container body comprising one or more receiving slots each comprising an aperture through which the tool body is inserted;

b. a locking mechanism configured to lock the group of one or more T-handle tools within the tool container body; and c. a receiving member for receiving the tool handle and that allows the tool handle to be stored on the tool container, wherein the cavity of the tool handle fits over the receiving member to store the tool handle on the tool container.

2. The T-handle tool container of claim 1 wherein the one or more receiving slots are configured in columns.

3. The T-handle tool container of claim 1 wherein the tool container is configured to hold standard American sized tools or metric sized tools.

4. The T-handle tool container of claim 1 wherein the locking mechanism comprises a tab that is able to move between a lock position and an unlock position.

5. The T-handle tool container of claim 1 wherein the locking mechanism comprises an element movable between a locked position and an unlock position and that applies pressure to the one or more T-handle tools so they are not removable when the element is in the locked position.

6. The T-handle tool container of claim 1 wherein the tool container comprises a tamper prevention mechanism that prevents the locking mechanism from moving to the unlock position.

7. The T-handle tool container of claim 1 wherein the tool container is configured to be hung on a display.

8. The T-handle tool container of claim 1 wherein the one or more T-handle tools are stored in a criss-cross configuration.

9. A T-handle tool container for holding a plurality of T-handle tools each having a long leg member and a short handle member and in the shape of a T and a tool handle comprising a cavity for receiving one of the plurality of the T-handle tools, the tool container comprising:

a. a tool container body configured to hold a group of one or more T-handle tools of multiple sizes securely upon insertion into the tool container, the tool container body comprising one or more receiving slots each comprising an aperture through which the tool body is inserted;

b. a locking mechanism configured to lock the group of one or more T-handle tools within the tool container body; and c. a receiving member for receiving the tool handle and that allows the tool handle to be stored on the tool container, wherein the cavity of the tool handle fits over the receiving member to store the tool handle on the tool container, wherein the tool container comprises a tamper prevention mechanism that prevents the locking mechanism from moving to the unlock position and further wherein the tool container is configured to be hung on a display.

10. The T-handle tool container of claim 9 wherein the one or more receiving slots are configured in columns.

11. The T-handle tool container of claim 9 wherein the locking mechanism comprises a tab that is able to move between a lock position and an unlock position.

12. A T-handle tool container for holding a plurality of T-handle tools each having a long leg member and a short handle member and in the shape of a T and a tool handle comprising a cavity for receiving one of the plurality of the T-handle tools, the tool container comprising:

a. a tool container body configured to hold a group of one or more T-handle tools of multiple sizes securely upon insertion into the tool container, wherein the tool container comprises one or more receiving slots for receiving the one or more T-handle tools, each of the receiving slots comprising an aperture through which the tool body is inserted;

b. a locking mechanism configured to lock the group of one or more T-handle tools within the tool container body; and c. a receiving member for receiving the tool handle and that allows the tool handle to be stored on the tool container, wherein the cavity of the tool handle fits over the receiving member to store the tool handle on the tool container, wherein the tool container comprises a tamper prevention mechanism that prevents the locking mechanism from moving to the unlock position.

13. The T-handle tool container of claim 12 wherein the locking mechanism comprises a tab that is able to move between a lock position and an unlock position.

14. The T-handle tool container of claim 12 wherein the locking mechanism comprises an element movable between a locked position and an unlock position and that applies pressure to the one or more T-handle tools so they are not removable when the element is in the locked position.

15. The T-handle tool container of claim 12 wherein the tool container is configured to be hung on a display.

* * * * *